US006736679B2

(12) United States Patent
Hung

(10) Patent No.: US 6,736,679 B2
(45) Date of Patent: May 18, 2004

(54) SHUNT RECEPTACLE AND PLUG DEVICE

(76) Inventor: Teng-Shun Hung, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/231,310

(22) Filed: Aug. 28, 2002

(65) Prior Publication Data

US 2004/0043666 A1 Mar. 4, 2004

(51) Int. Cl.[7] ..... H01R 25/00
(52) U.S. Cl. ..... 439/651
(58) Field of Search ..... 439/651, 535, 439/136, 142, 149, 501

(56) References Cited

U.S. PATENT DOCUMENTS 5,419,716 A * 5/1995 Sciammarella et al. .. 439/540.1
5,466,165 A * 11/1995 Boesel et al. ..... 439/142
5,700,158 A * 12/1997 Neiser et al. ..... 439/501
5,816,824 A * 10/1998 White et al. ..... 439/35
6,004,157 A * 12/1999 Glass ..... 439/574
6,077,109 A * 6/2000 Prazoff ..... 439/501
6,200,159 B1 * 3/2001 Chou ..... 439/535
6,207,895 B1 * 3/2001 Engel ..... 174/53

* cited by examiner

*Primary Examiner*—Gary Paumen
*Assistant Examiner*—James R. Harvey

(57) ABSTRACT

A shunt receptacle and plug device has a main case, a head cover, an end cover, and a pair of disk fasteners. The end cover has a receptacle set and a pair of opposite notches. The main case has a pair of plug blades, an electric source socket set, a pair of telephone socket slots, two pairs of opposite insertion grooves, two opposite positioning apertures, and a top illumination indicator. The head cover has a pair of opposite circular holes, a top oblong hole, and a pair of side holes. The end cover covers the main case. The head cover covers the main case. Each disk fastener is disposed on the head cover.

1 Claim, 5 Drawing Sheets

SHUNT RECEPTACLE AND PLUG DEVICE

BACKGROUND OF THE INVENTION

The present invention relates to a shunt receptacle and plug device. More particularly, the present invention relates to a shunt receptacle and plug device which is connected to an electric source plug and a telephone cord plug.

A conventional receptacle device receives an electric source plug only. Another conventional receptacle device receives a telephone cord plug only. When a personal computer is communicated with a network, two or more conventional receptacle devices are required.

SUMMARY OF THE INVENTION

An object of the present invention is to provide a shunt receptacle and plug device which can be connected to an electric source plug and a telephone cord plug at the same time.

Another object of the present invention is to provide a shunt receptacle and plug device which has an end cover to cover a main case while a pair of plug blades of the main case is not used.

Another object of the present invention is to provide a shunt receptacle and plug device which has a head cover to cover an end cover so that the end cover will not be disengaged from the main case.

Accordingly, a shunt receptacle and plug device comprises a main case, a head cover, an end cover, and a pair of disk fasteners. The end cover has a receptacle set and a pair of opposite notches. The main case has a pair of plug blades disposed on a first side of the main case, an electric source socket set disposed on a second side of the main case, a pair of telephone socket slots formed on the second side of the main case, two pairs of opposite insertion grooves, two opposite positioning apertures, and a top illumination indicator. The head cover has a pair of opposite circular holes, a top oblong hole, and a pair of side holes. Each of the disk fasteners has a positioning pin and a pair of click pillars. The end cover covers the main case. The head cover covers the main case. Each of the disk fasteners is disposed on the head cover. Each positioning pin is inserted in the corresponding positioning aperture of the main case. Each click pillar inserted in the corresponding insertion groove of the main case.

DETAILED DESCRIPTION OF THE INVENTION

Figure 1:
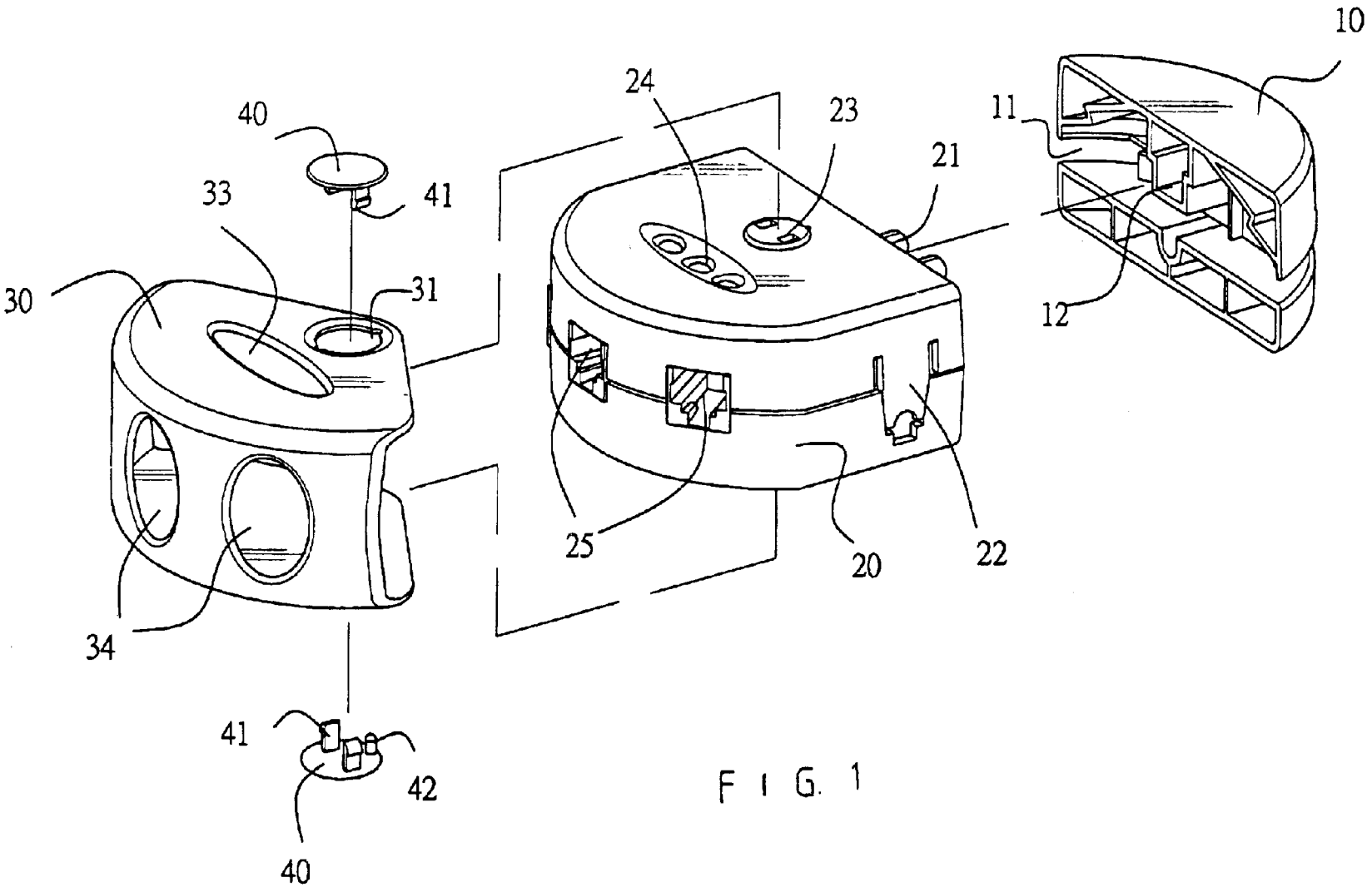
FIG. 1 is a perspective exploded view of a shunt receptacle and plug device of a preferred embodiment in accordance with the present invention.
Figure 2:
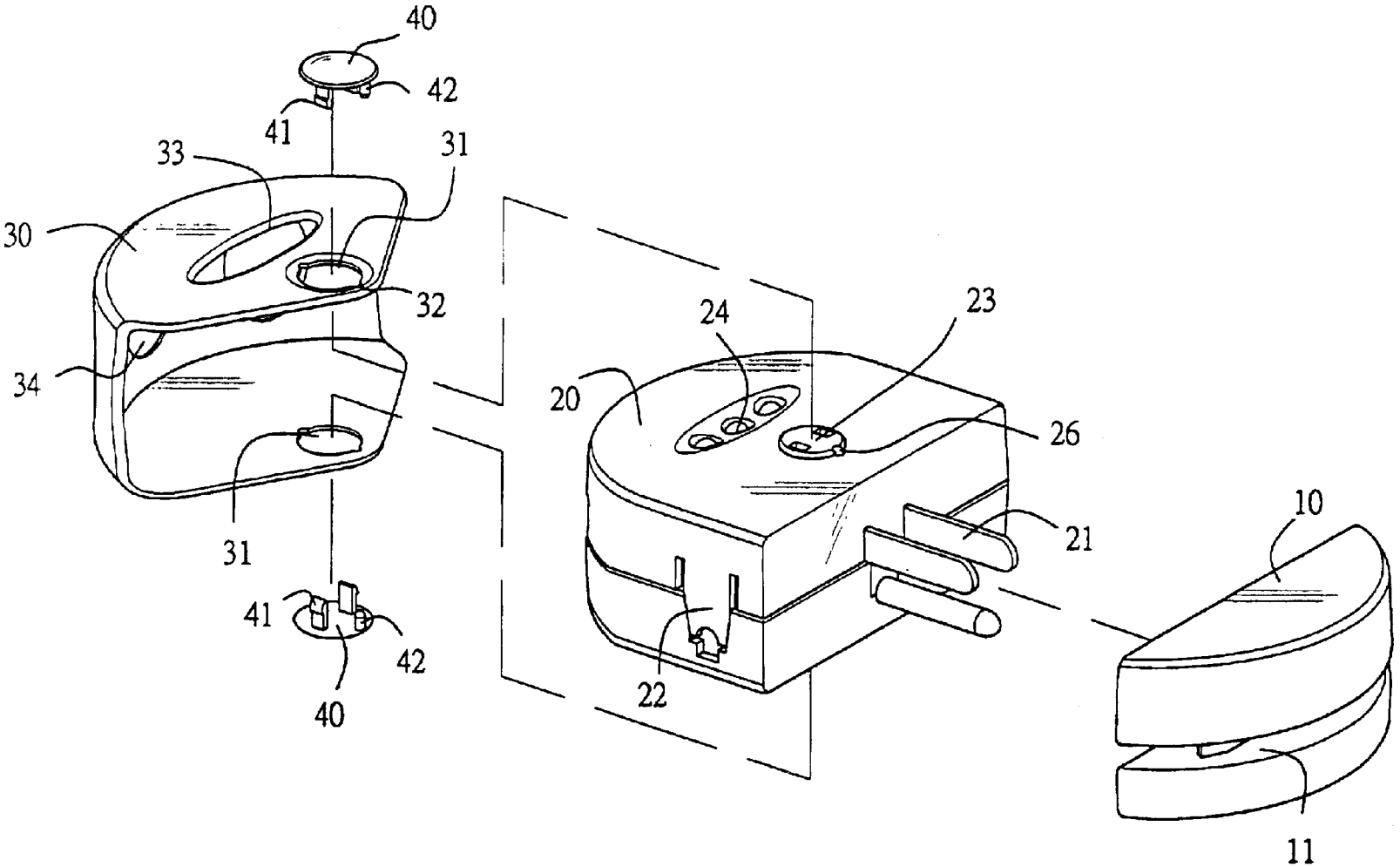
FIG. 2 is another perspective exploded view of a shunt receptacle and plug device of a preferred embodiment in accordance with the present invention.

Referring to FIGS. 1 to 6, a shunt receptacle and plug device comprises a main case 20, a head cover 30, an end cover 10, and a pair of disk fasteners 40.

The end cover 10 has a receptacle set 12 and a pair of opposite notches 11.

The main case 20 has a pair of plug blades 21 disposed on a first side of the main case, a post 27 disposed under the plug blades 21 for grounding, an electric source socket set 22 disposed on a second side of the main case 20, a pair of telephone socket slots 25 formed on the second side of the main case 20, two pairs of opposite insertion grooves 23, two opposite positioning apertures 26, and a top illumination indicator 24. The main case 20 has an inside provided with conducting wire (not shown in the figure) for connecting the plug blades 21, the electric source socket set 22 and the telephone socket slots 25.

The head cover 30 has a pair of opposite circular holes 31, a top oblong hole 33, and a pair of side holes 34.

Each of the disk fasteners 40 has a positioning pin 42 and a pair of click pillars 41.

The post 27 is inserted in the end cover 10 when not in use.

The end cover 10 covers the main case 20.

The head cover 30 covers the main case 20.

Each of the disk fasteners 40 is disposed on the head cover 30.

Each positioning pin 42 is inserted in the corresponding positioning aperture 26 of the main case 20.

Each click pillar 41 is inserted in the corresponding insertion groove 23 of the main case 20.

Figure 3:
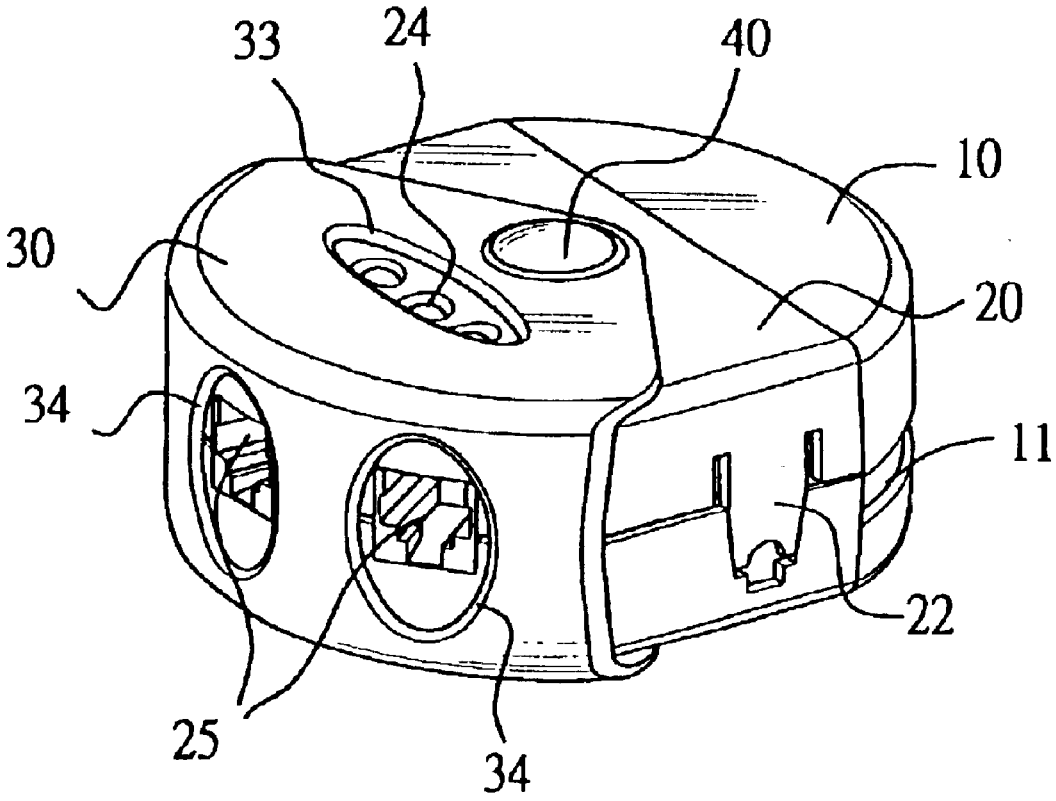
FIG. 3 is a perspective assembly view of a shunt receptacle and plug device of a preferred embodiment in accordance with the present invention.
Figure 4:
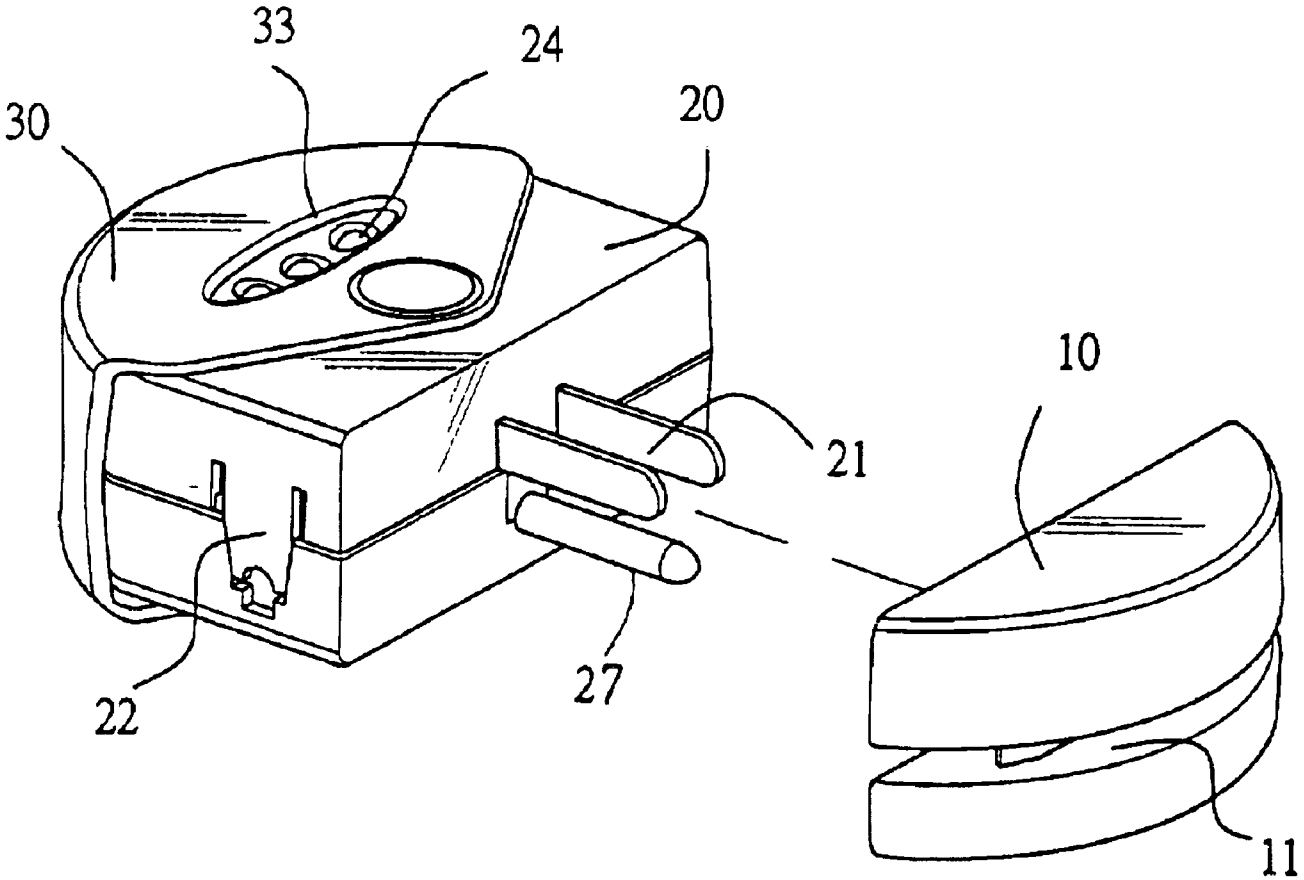
FIG. 4 is a perspective exploded view of a main case and an end cover of a preferred embodiment in accordance with the present invention.

Referring to FIGS. 3 and 4, the plug blades 21 are inserted in the receptacle set 12 of the end cover 10 when not in use.

Figure 5:
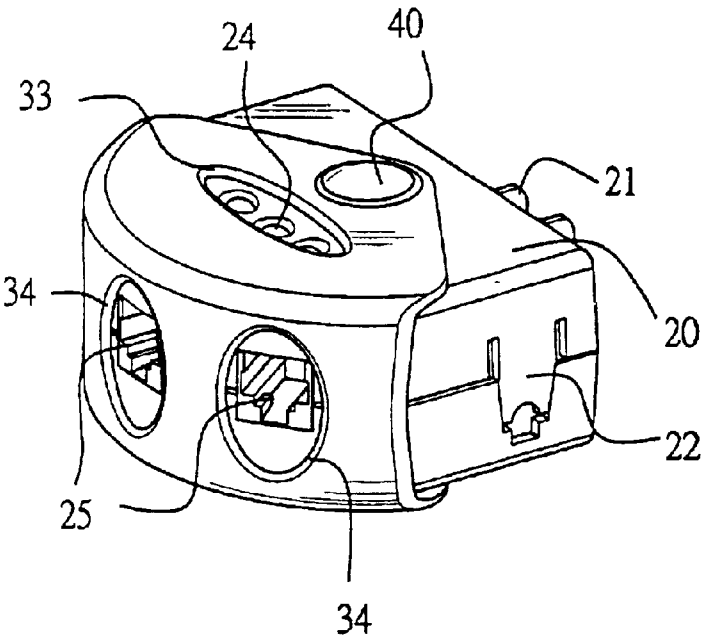
FIG. 5 is a perspective assembly view of a shunt receptacle and plug device without end cover.

Referring to FIG. 5, the end cover 10 is removed. An electric source plug (not shown in the figure) engages with two side slots (not labeled) of the electric source socket set 22.

Figure 6:
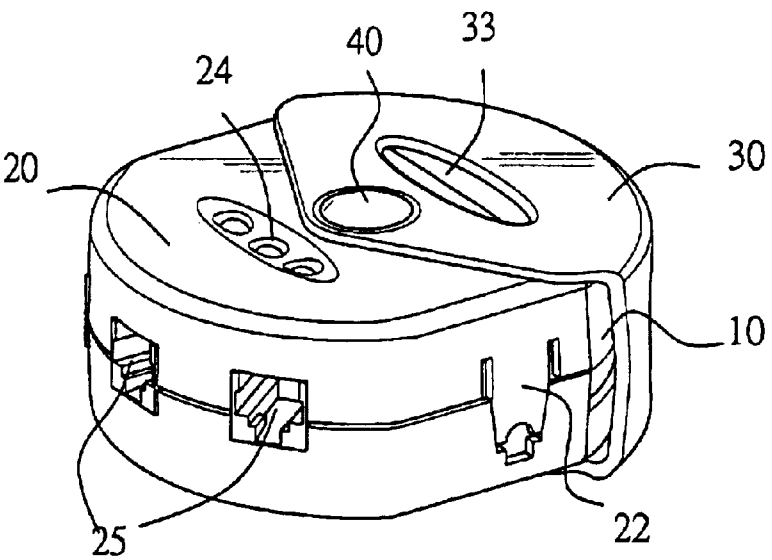
FIG. 6 is a perspective schematic view illustrating a head cover covering an end cover.

Referring to FIG. 6, the head cover 30 is rotated to cover the end cover 10. One of the telephone socket slots 25 of the main case 20 is connected to a telephone cord plug (not shown in the figure) so that the main case 20 has a telephone shunting function.

The opposite notches 11 of the end cover 10 receives a winding telephone cord (not shown in the figure).

The invention is not limited to the above embodiment but various modification thereof may be made. Further, various changes in form and detail may be made without departing from the scope of the invention.

I claim:

1. A shunt receptacle and plug device comprises:

a main case, a head cover, an end cover, and a pair of disk fasteners, the end cover having a receptacle set and a pair of opposite notches, the main case having a pair of plug blades disposed on a first side of the main case, an electric source socket set disposed on a second side of the main case, a pair of telephone socket slots formed on the second side of the main case, two pairs of opposite insertion grooves, two opposite positioning apertures, and atop illumination indicator, the head cover having a pair of opposite circular holes, a top oblong hole, and a pair of side holes, each said disk fastener having a positioning pin and a pair of click pillars, the end cover covering the main case, the head cover covering the main case, each said disk fastener disposed on the head cover, each said positioning pin inserted in the corresponding positioning aperture of the main case, and each said click pillar inserted in the corresponding insertion groove of the main case.

* * * * *